US005483775A

United States Patent [19]

Redman

[11] Patent Number: 5,483,775

[45] Date of Patent: Jan. 16, 1996

[54] ADJUSTABLE SETTING BLOCK ASSEMBLY

[75] Inventor: Ronald E. Redman, Lawrenceville, Ga.

[73] Assignee: Kawneer Company, Inc., Norcross, Ga.

[21] Appl. No.: 193,932

[22] Filed: Feb. 9, 1994

[51] Int. Cl.[6] ..... E06B 1/04

[52] U.S. Cl. ..... 52/204.62; 254/98

[58] Field of Search ..... 52/217, 2 B, 208, 52/126.1, 126.4, 126.7, 204.62, 204.64, 204.65, 241, 204.66; 254/98, 100; 269/277; 248/650, 188.4, 295.1, 298

[56] References Cited

U.S. PATENT DOCUMENTS 3,204,493 9/1963 Nalle ..... 254/98 X
4,920,717 5/1990 Hooper, Jr. .

OTHER PUBLICATIONS

P. C1–6 of Kawneer's "Storefronts, Entrances, Facings, Curtainwalls, Windows, Overhead Glazing" Manual (Litho in U.S.A., Jan., 1980).

*Primary Examiner*—Carl D. Friedman
*Assistant Examiner*—Creighton Smith
*Attorney, Agent, or Firm*—Jones & Askew

[57] ABSTRACT

An adjustable setting block assembly is disclosed for supporting and leveling infill panels such as window panes and the like. The setting block assembly includes a setting block and a thrust plate positioned adjacent the lower surface of the block. A bolt is threadingly engaged within a threaded bore in the block, and the bolt has a tip which bears against the thrust plate as the bolt is advanced within the threaded bore. A load exerted on the upper surface of the block, such as by a glass light resting on the block, is thus supported by the tip of the bolt bearing against the thrust plate. In the disclosed embodiment the tip of the bolt which bears against the thrust plate is radiused to facilitate limited pivotable movement between the bolt and the thrust plate. Also in the disclosed embodiment a pad is imposed against the upper surface of the block to provide a cushioned surface for supporting the glass lite. Preferably the thrust plate and pad are temporarily affixed to the block by an adhesive bond, such as that provided by double-sided tape.

20 Claims, 5 Drawing Sheets

ADJUSTABLE SETTING BLOCK ASSEMBLY

TECHNICAL FIELD

The present invention relates generally to means for supporting and leveling glass panes, infill panels, and the like, and relates more specifically to an adjustable, single-point loading setting block assembly.

BACKGROUND OF THE INVENTION

In conventional storefront and curtainwall framing systems, precise alignment of the glass lites is not critical. Because the edges of the light are received within glazing pockets formed in adjacent frame members, the edges of the lite are concealed, and minor misalignment is hidden from view.

However, with the advent of the so-called "butt-glazed" or "full view" storefront and curtainwall framing systems, in which the vertical edge of one glass lite is butted against the corresponding vertical edge of the adjacent glass lite, alignment of the glass panels became critical. Since the vertical edges of the glass lites were no longer concealed within the glazing pockets of vertical frame members, any deviation of the edge of the glass lite from vertical was readily apparent. Further, because of the considerable height of the glass lites in a storefront or curtainwall framing system, even an extremely minor misalignment of a glass lite could result in a considerable gap at the top or bottom of the joint.

Conventional practice calls for such glass lites to be leveled by inserting shims under the low end of the lite. This practice can cause problems, however, because such shims can sometimes cause the weight of the glass lite to rest on a single point, rather than being distributed across a wider area. The Flat Glass Manufacturers Association recommends that the weight of a glass lite be supported along a length of at least four inches. However, even when a four-inch long shim is used, the weight of the glass lite will often rest entirely on the "high end" of the shim, causing point contact between the glass lite and the shim which can exert undue stresses in the glass lite.

Thus there is a need for an improved arrangement for supporting and leveling glass lites in storefront and curtainwall framing systems.

There is a further need to provide an apparatus for supporting and leveling glass lites which ensures that the weight of the lite is supported along at least four inches of the lower edge of the lite.

There is still a further need for an apparatus for supporting and leveling glass lites which provides precise control over the alignment of the glass lite.

SUMMARY OF THE INVENTION

As will be seen, the present invention overcomes these and other problems associated with prior art setting blocks. Stated generally, the present invention comprises an adjustable setting block assembly for supporting and leveling window panes and the like. The setting block assembly includes block having an upper surface and a lower surface and defining a threaded bore therethrough. A thrust plate is positioned adjacent the lower surface of the block. A bolt is threadingly engaged with the threaded bore of the block, and the bolt has a tip which bears against the thrust plate as the bolt is advanced within the threaded bore. A load exerted on the upper surface of the block, such as by a glass light resting on the block, is Thus supported by the tip of the bolt bearing against the thrust plate. In the disclosed embodiment the tip of the bolt which bears against the thrust plate is radiused to facilitate limited pivotable movement between the bolt and the thrust plate. Also in the disclosed embodiment a pad is imposed against the upper surface of the block to provide a cushioned surface for supporting the glass lite. Preferably the thrust plate and pad are temporarily affixed to the block by an adhesive bond, such as that provided by double-sided tape.

In another aspect, the present invention comprises a framing system comprising an adjustable setting block assembly of the type previously described.

Thus it is an object of the present invention to provide an improved means for adjustably supporting glass infill panels and the like.

It is a further object of the present invention to provide an apparatus for supporting and leveling glass lites which ensures that the weight of the lite is supported along a suitable length of the lower edge of the lite.

Still another object of the present invention is to provide an apparatus for supporting and leveling glass lites which provides precise control over the alignment of the glass lite.

Other objects, features, and advantages of the present invention will become apparent upon reading the following specification, when taken in conjunction with the drawings and the appended claims.

DETAILED DESCRIPTION OF THE DISCLOSED EMBODIMENT

Figure 1:
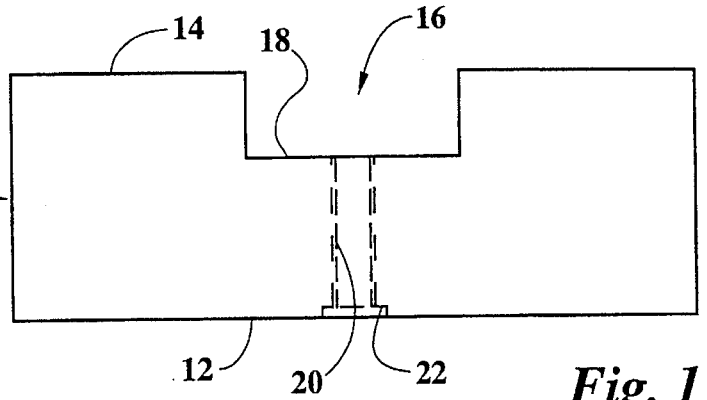
FIG. 1 is a side view of a setting block according to the present invention.

Referring now to the drawings, in which like numerals indicate like elements throughout the several views, FIG. 1 shows a setting block 10 which comprises a component of the adjustable setting block assembly of the present invention. The setting block 10 of the disclosed embodiment is fabricated from aluminum bar. The setting block 10 comprises a base 12 and an upper service 14. A recess 16 is formed in the upper service 14 and defines a bottom wall 18. A threaded through bore 20 extends vertically through the setting block 10 between the bottom wall 18 of the recess 16 and the base 12. At the lower end of the bore 20 a counterbore 22 is formed.

Figure 2:
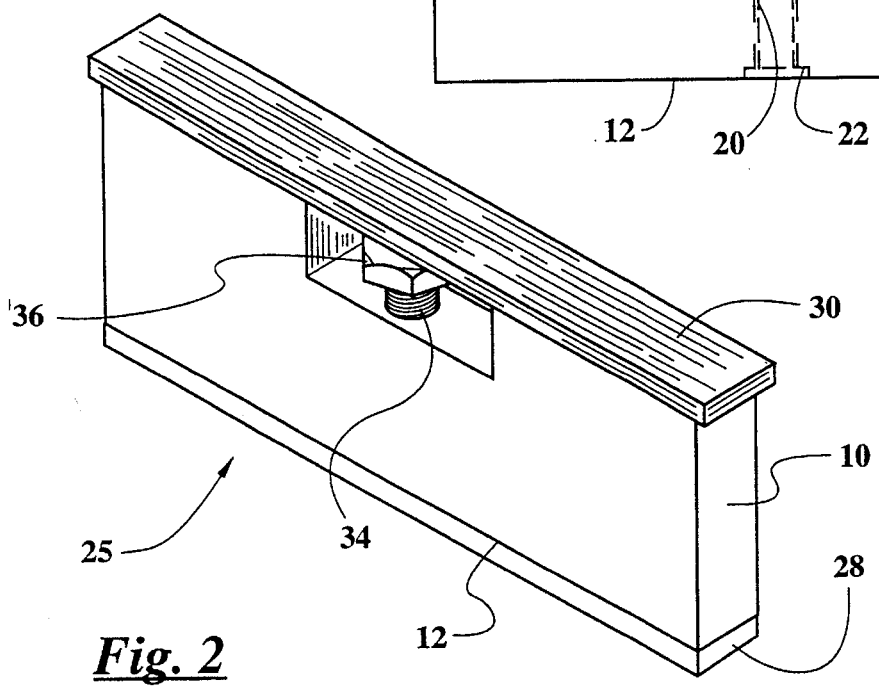
FIG. 2 is an isometric view of an adjustable setting block assembly comprising the setting block of FIG. 1
Figure 3:
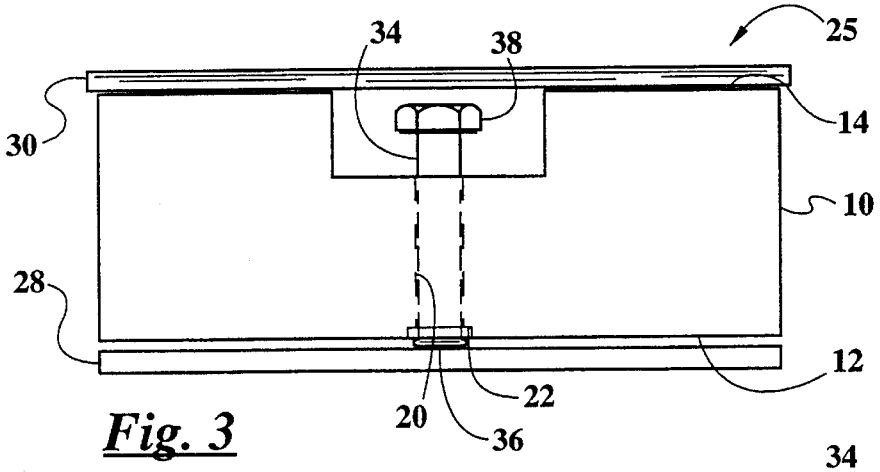
FIG. 3 is a side view of the adjustable setting block assembly of FIG. 2.

Referring now to FIGS. 2 and 3, an adjustable setting block assembly 25 comprises the setting block 10 previously described. A thrust plate 28 is positioned against the base 12 of the setting block 10. In the disclosed embodiment the thrust plate 28 is fabricated from ⅛" steel. The thrust plate 28 is releasably held against the base 12 of the setting block 10 by double-sided tape.

A pad 30 of elastomeric material is disposed against the upper surface 14 of the setting block 10 and spans the recess 16. The pad 30 is held in place against the upper surface 14 of the setting block 10 by double-sided adhesive tape.

Figure 4:
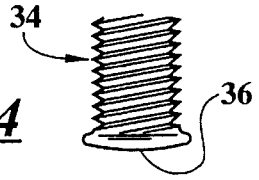
FIG. 4 is an enlarged view of the tip of a bolt of the adjustable setting block assembly of FIG. 3.

A ¼-20×1 5/16" hex head machine screw 34 having a tip 36 and a head 38 is threadingly engaged within the threaded bore 20. As shown in FIG. 4, after being threaded through the bore 20, the tip 36 of the bolt 34 is staked to prevent the bolt from being backed out of the threaded bore. In addition, the tip 36 of the bolt 34 is radiused, for reasons which will become apparent when the operation of the setting block assembly 25 is explained hereinbelow. When the bolt 34 is fully retracted, the staked tip 36 is recessed within the counterbore 22, thereby permitting the thrust plate 28 to lie flat against the base 12 of the setting block 10.

As can be seen in FIG. 3, when the head 38 of the bolt 36 is turned using a conventional open-end wrench, the bolt advances downward such that the tip 36 of the bolt 34 bears against the thrust plate 28. With the bottom of the thrust plate 28 resting on a support surface, continued turning of the bolt 34 will break the adhesive tape bond between the thrust plate 28 and the base 12 of the setting block 10 and will elevate the setting block 10 above the thrust plate 28. In this configuration the setting block 10 is supported on the radiused tip 36 of the bolt 34.

Figure 5A:
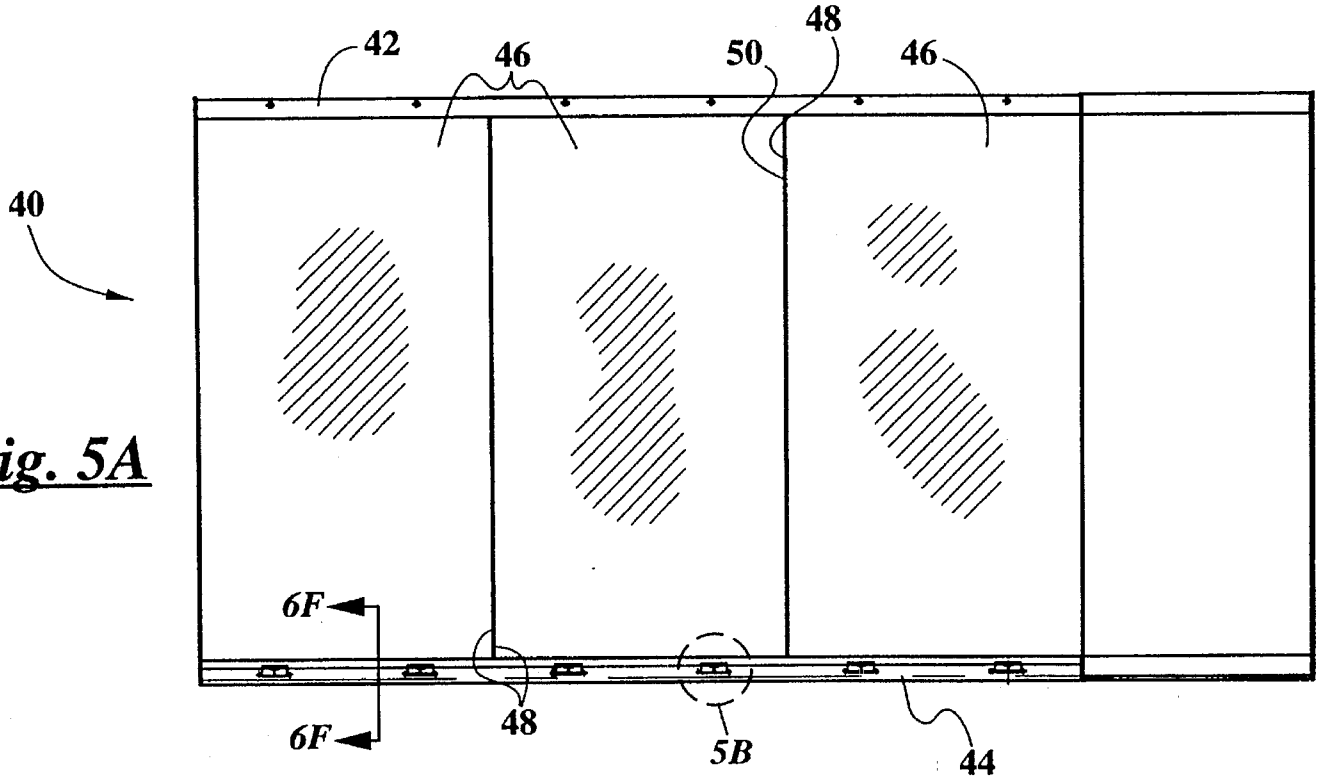
FIG. 5A is a side view of a storefront framing system which is illustrative of an application which employs the adjustable setting block assembly of the present invention.
Figure 5B:
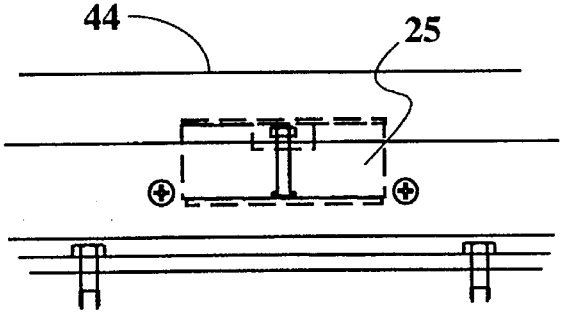
FIG. 5B is an enlarged view of the area indicated by the circle 5B in FIG. 5A.

FIGS. 5A and 5B illustrate a full vision sidelite installation 40 in which adjacent glass lites are butt-glazed. The sidelite installation 40 comprises a head 42, a sill 44, and a plurality of ½" thick tempered glass lites 46. The installation 40 is called "full vision" because the vertical edges 48 of the glass lites 46 are visible, rather than the joint being concealed by a vertical frame member. A ⅜" joint 50 filled with silicone adhesive is formed between adjoining vertical edges 48 of adjacent glass lites 46. Each glass lite 46 is supported by a pair of adjustable setting block assemblies 25. For proper load distribution each adjustable setting block assembly 25 is spaced inward from the vertical edge 48 of the glass lite 46 by a distance corresponding to twenty-five percent of the width of the glass lite.

Figure 6B:
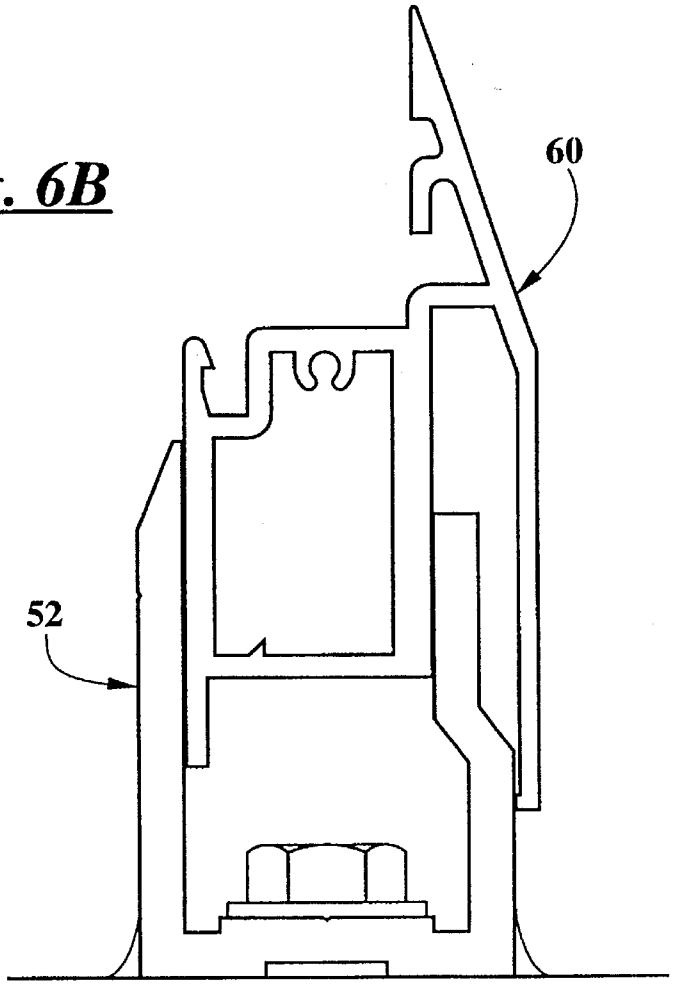
FIGS. 6A–F are a series of cross-sectional views depicting the assembly of the storefront framing system of FIG. 5A, with FIG. 6F corresponding to the section view taken along line 6F—6F of FIG. 5A.
Figure 6A:
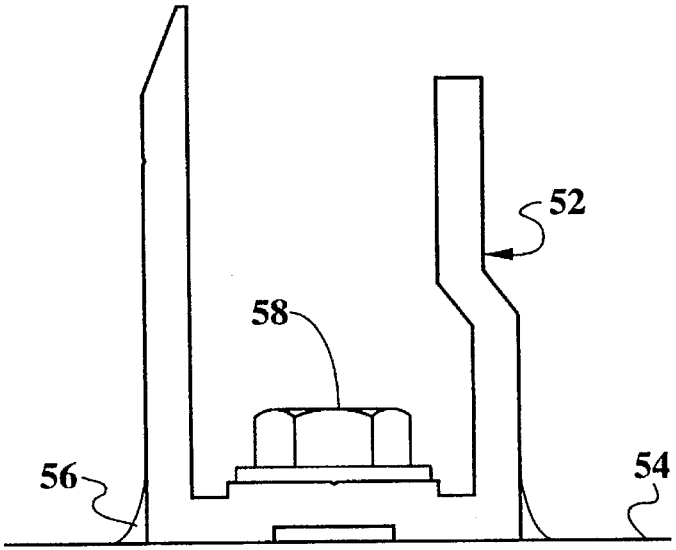

Assembly of the sill 44 will now be explained with reference to FIGS. 6A–6F. Referring first to FIG. 6A, a base 52 is set on a support surface 54 in a bed of sealant 56 and anchored to the support surface by a 2½" lag screw 58. As shown in FIG. 6B, a gutter 60 is then set in place on the base 52 and leveled. When the gutter 60 is properly positioned, it is fastened to the base 52 by a plurality of screws.

Figure 6D:
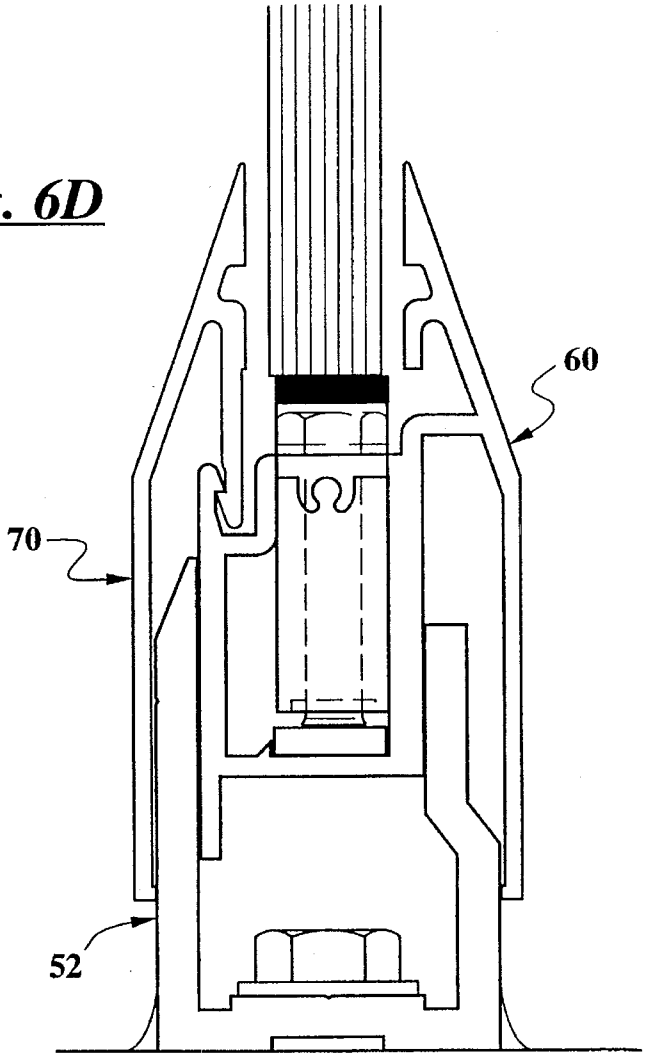
Figure 6C:
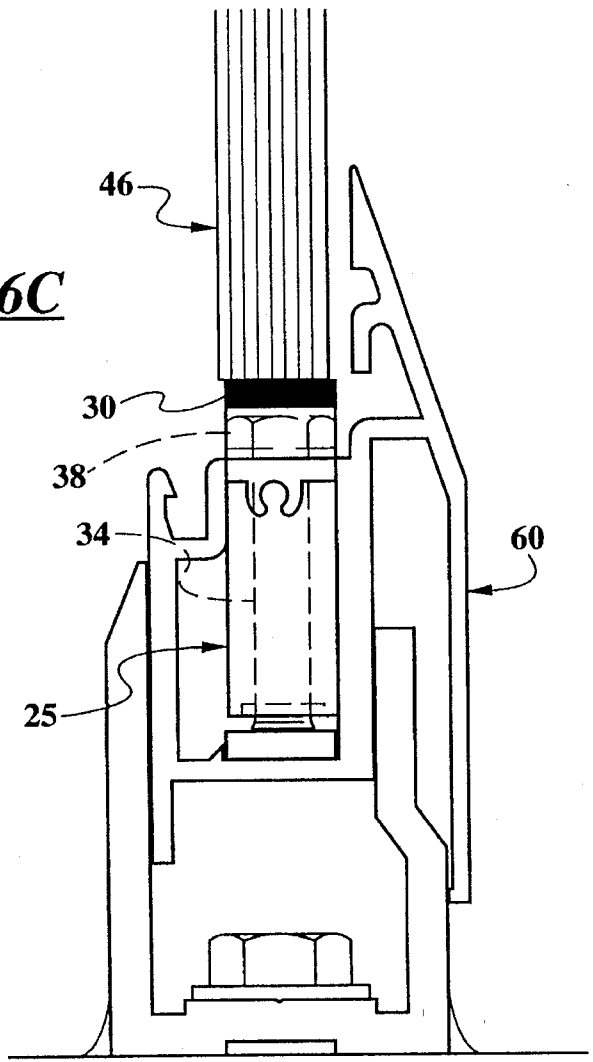

Referring now to FIG. 6C, adjustable setting block assemblies 25 are now set inside the gutter 60 at appropriate spaced intervals. The glass lites 46 are then set in place atop the pads 30 of the setting block assemblies 25. Using a wrench, the heads 38 of the bolts 34 of the setting block assemblies 25 are turned to adjust the height of each setting block assembly to bring the edges 48 (FIG. 5A) of each glass lite 46 vertical and to make adjoining edges of adjacent glass lites 46 parallel. Advancing the bolt 34 will raise the setting block assembly 25, while retracting the bolt will lower the setting block assembly.

As shown in FIG. 6D, after the glass lites have been property adjusted, a face 70 is installed onto the gutter 60 and base 52. As seen in FIG. 6E, interior and exterior cladding 72, 74 is optionally installed onto the face 70 and gutter 60. The cladding is decorative and may be beveled, curved, or square. The cladding may be provided in aluminum, stainless steel, brass, or other suitable material.

Figure 6F:
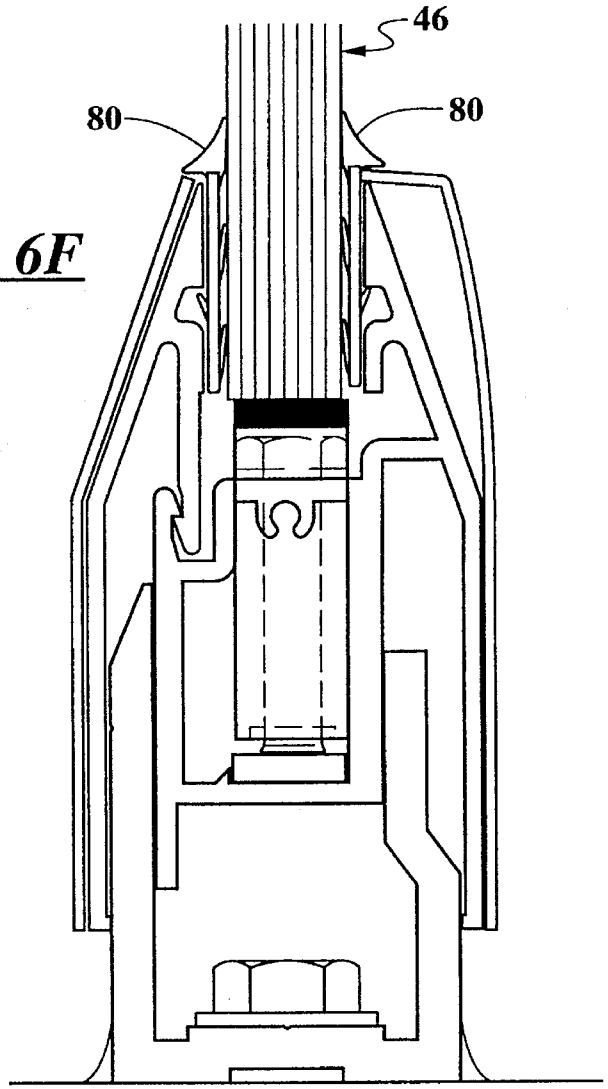
Figure 6E:
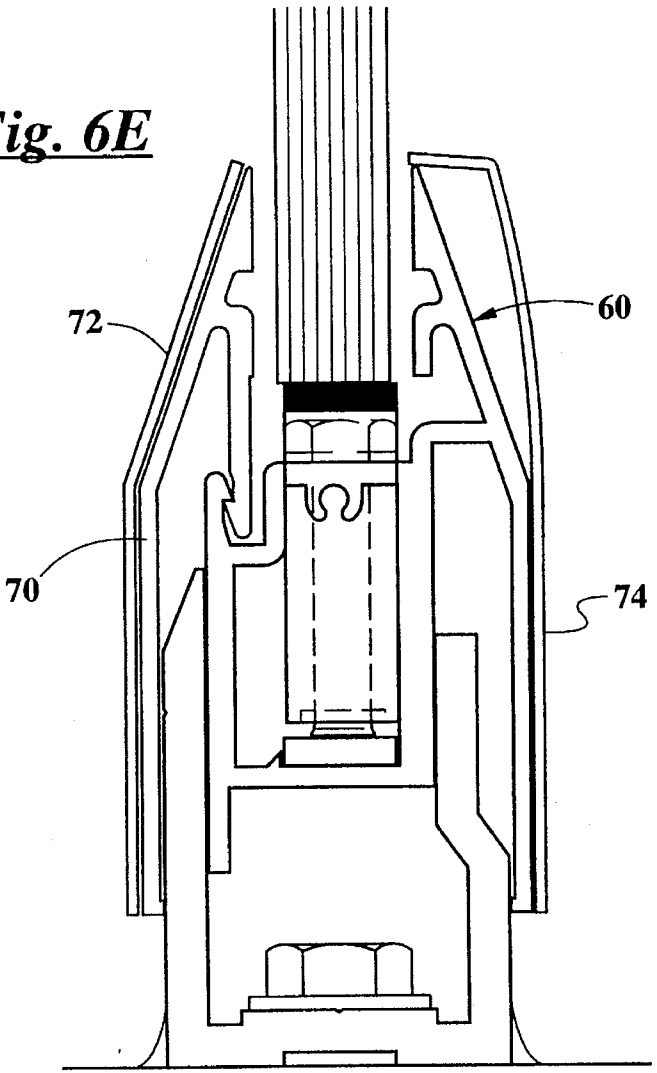

Referring now to FIG. 6F, gaskets 80 are driven into place on both sides of the glass lites 46. The gaskets 80 provide for a separation of the glass and aluminum components, thereby protecting the glass lites 46 and insulating the system.

A feature of the disclosed embodiment is that the setting block 10 rotates upon the radiused tip 36 of the bolt 34 so that the pad 30 of the setting block assembly 25 maintains continuous contact along its entire length with the lower edge of the corresponding glass lite 46. In this manner, the weight of the glass lite is distributed across a sufficiently wide area that undue stresses are avoided. In the disclosed embodiment each setting block supports the glass lite along at least a 4" run, thereby meeting the standards of the Flat Glass Manufacturers Association.

Another feature of the disclosed embodiment is the utilization of the steel thrust plate 28, which serves as a bearing surface for the tip 36 of the bolt 34. The thrust plate 28 distributes the load exerted on the aluminum gutter 60 across an area corresponding to the "footprint" of the thrust plate. Without a thrust plate, the stresses resulting from a point contact between the bolt tip 36 and the aluminum gutter 60 might be sufficient to indent or deform the aluminum gutter and might adversely affect alignment of the glass lites 46.

While the disclosed embodiment employs double-sided adhesive tape to affix the pad 30 and thrust plate 28 temporarily to the setting block 10, it will be appreciated that other means for temporarily securing the pad and thrust plate to the setting block, such as an adhesive, a rubber band, or the like may be used, or that the setting block assembly 25 can be utilized with the thrust plate 28, setting block 10, and pad 30 merely placed atop one, another without any temporary fastening means.

While the present invention has been disclosed with respect to a setting block assembly 25 used in a "butt-glazed" or "full view" storefront or curtainwall framing system, it will be appreciated that the setting block assembly is not limited to these applications but is also suitable for use in other types of storefront or curtainwall framing systems, in windows, in handrail systems such as that disclosed in U.S. Pat. No. 4,920,717, and in any other application in which infill panels must be adjustably supported.

Finally, it will be understood that the preferred embodiment has been disclosed by way of example, and that other modifications may occur to those skilled in the art without departing from the scope and spirit of the appended claims.

What is claimed is:

1. An adjustable setting block assembly for supporting and leveling window panes and the like, comprising:

a block having an upper surface and a lower surface, said block having a recess formed in said upper surface, and said block defining a threaded bore between said lower surface and said recess;

a thrust plate positioned adjacent said lower surface of said block; and a bolt threadingly engaged with said threaded bore of said block, said bolt having a tip which bears against said thrust plate as said bolt is advanced within said threaded bore such that a load exerted on said upper surface of said block is supported by said tip of said bolt bearing against said thrust plate, and said bolt comprising a means at its upper end which can be engaged by a tool to turn said bolt.

2. The adjustable setting block of claim 1, wherein said tip of said bolt which bears against said thrust plate is radiused to facilitate limited pivotable movement between said bolt and said thrust plate.

3. The adjustable setting block of claim 1, wherein said thrust plate is initially imposed against said lower surface of said block, and wherein said thrust plate is releasably held against said block by an adhesive.

4. The adjustable setting block of claim 3, wherein said adhesive is disposed on a tape.

5. The adjustable setting block of claim 4, wherein said tape comprises adhesive on both sides thereof.

6. The adjustable setting block of claim 1, further comprising a pad imposed against said upper surface of said block.

7. The adjustable setting block of claim 6, wherein said pad is affixed to said upper surface of said block by adhesive.

8. The adjustable setting block of claim 7, wherein said adhesive is disposed on a tape.

9. The adjustable setting block of claim 8, wherein said tape comprises adhesive on both sides thereof.

10. The adjustable setting block of claim 1, wherein said bolt is staked to prevent backout.

11. A framing system comprising:

a sill member having a support surface defined thereon;

a thrust plate disposed upon said support surface of said sill member;

a block having an upper surface and a lower surface, said block having a recess formed in said upper surface, and said block defining a threaded bore between said lower surface and said recess, said block being disposed atop said thrust plate;

a bolt threadingly engaged with said threaded bore of said block, said bolt having a tip which bears against said thrust plate as said bolt is advanced within said threaded bore; and an infill panel having a lower edge supported by said block, whereby said infill panel resting on said upper surface of said block is supported by said tip of said bolt bearing against said thrust plate.

12. The framing system of claim 11, wherein said tip of said bolt which bears against said thrust plate is radiused to facilitate limited pivotable movement between said bolt and said thrust plate.

13. The framing system of claim 11, wherein said thrust plate is initially imposed against said lower surface of said block, and wherein said thrust plate is releasably held against said block by an adhesive.

14. The framing system of claim 13, wherein said adhesive is disposed on a tape.

15. The framing system of claim 14, wherein said tape comprises adhesive on both sides thereof.

16. The framing system of claim 11, further comprising a pad imposed against said upper surface of said block such that said lower edge of said infill panel rests upon said pad.

17. The framing system of claim 16, wherein said pad is affixed to said upper surface of said block by adhesive.

18. The framing system of claim 17, wherein said tape comprises adhesive on both sides thereof.

19. The framing system of claim 11, wherein said bolt is slaked to prevent backout.

20. The framing system of claim 11, wherein said infill panel comprises a glass lite.

* * * * *